US010894282B2

(12) United States Patent
Oei et al.

(10) Patent No.: US 10,894,282 B2
(45) Date of Patent: Jan. 19, 2021

(54) TOOL AND PROCESS FOR FORMING DESTACKING FORMATIONS ON METAL BLANKS

(71) Applicants: Charles T. Oei, Greenville, SC (US); Rajat Bhute, Greenville, SC (US)

(72) Inventors: Charles T. Oei, Greenville, SC (US); Rajat Bhute, Greenville, SC (US)

(73) Assignee: Magna International Inc., Aurora (CA)

( * ) Notice: Subject to any disclaimer, the term of this patent is extended or adjusted under 35 U.S.C. 154(b) by 652 days.

(21) Appl. No.: 15/599,891

(22) Filed: May 19, 2017

(65) Prior Publication Data

US 2017/0333969 A1 Nov. 23, 2017

Related U.S. Application Data

(60) Provisional application No. 62/338,877, filed on May 19, 2016.

(51) Int. Cl.

| | |
|---|---|
| ***B21D 17/04*** | (2006.01) |
| ***B21D 13/00*** | (2006.01) |
| ***B44B 5/00*** | (2006.01) |
| ***B21D 13/04*** | (2006.01) |

(52) U.S. Cl.

CPC ..... *B21D 17/04* (2013.01); *B21D 13/04* (2013.01); *B44B 5/00* (2013.01)

(58) Field of Classification Search

CPC ..... B21D 17/04; B21D 13/04; B21D 22/04; B44B 5/00; B44B 5/0004; B44B 5/0009

USPC ..... 72/252.5, 75

See application file for complete search history.

(56) References Cited

U.S. PATENT DOCUMENTS

| | | | | | |
|---|---|---|---|---|---|
| 2,732,886 | A | * | 1/1956 | Andreoli et al. | B21D 13/04 156/206 |
| 3,670,547 | A | * | 6/1972 | Granger | B23B 51/08 72/75 |
| 4,257,251 | A | * | 3/1981 | Jury | B21D 13/04 72/184 |
| 5,186,033 | A | * | 2/1993 | Nieczyporowicz | B21D 17/04 72/123 |
| 5,575,168 | A | * | 11/1996 | Rosene | B21D 11/08 72/179 |
| 5,581,862 | A | * | 12/1996 | Choma | B21D 39/06 29/33 K |
| 5,673,585 | A | * | 10/1997 | Bishop | B21D 22/04 72/404 |

(Continued)

*Primary Examiner* — Adam J Eiseman
*Assistant Examiner* — Mohammed S. Alawadi
(74) *Attorney, Agent, or Firm* — Dickinson Wright PLLC

(57) ABSTRACT

A tool for manufacturing blanks and a process for stacking and destacking the blanks in a production line are provided. The tool is incorporated into a blanking die used to trim a metal sheet and form the blanks. When the blanks are stacked, the destacking formations provide gaps between the adjacent blanks. The gaps provide an entry to blast air and thus reliably separate the blanks for pick up, so that only one blank is picked up at a time. The tool includes a deforming unit that has an engagement element for pressing deformations into the metal sheet. The deformations are pressed adjacent to at least one edge of the metal sheet so that when the metal sheet is trimmed, and the blanks are stacked, they are spaced by the deformations by adjacently stacked blanks.

8 Claims, 8 Drawing Sheets

(56) References Cited

U.S. PATENT DOCUMENTS

| | | | | |
|---|---|---|---|---|
| 6,131,430 | A * | 10/2000 | Schneider | B21D 17/04 72/75 |
| 2009/0205389 | A1* | 8/2009 | Heusel | G05B 19/195 72/206 |
| 2016/0279687 | A1* | 9/2016 | Thomas | B21B 1/222 |
| 2017/0254081 | A1* | 9/2017 | Castellucci | E04C 3/07 |

* cited by examiner

TOOL AND PROCESS FOR FORMING DESTACKING FORMATIONS ON METAL BLANKS

CROSS REFERENCE TO RELATED APPLICATION

This U.S. Utility Patent Application claims the benefit of and priority to U.S. Provisional Patent Application Ser. No. 62/338,877, filed May 19, 2016, the entire disclosure of the application being considered part of the disclosure of this application, and hereby incorporated by reference.

BACKGROUND OF THE INVENTION

1. Field of the Invention

The invention relates generally to metal blanks used in production lines, methods of manufacturing the metal blanks, and more particularly to tools and process for destacking metal blanks in a production line.

2. Related Art

Metal blanks are oftentimes stacked in a production line for subsequent processing. For example, aluminum blanks can be stacked at the start of a press line, destacked, and transferred to a trimming, pressing, and/or stamping apparatus. The production process typically includes picking up the blanks from the stack and transferring the blanks to the trimming, pressing, and/or stamping apparatus. For example, a destacking robot or tool with suction cups can be used to pick up the blanks and transfer the blanks. It is necessary that only one blank is picked up and removed from the stack at a time. However, adjacent aluminum blanks oftentimes stick together, in which case multiple blanks are simultaneously picked up by the suction cups and unintentionally transferred to the trimming, pressing, and/or stamping apparatus.

Various methods have been proposed in attempt to improve the destacking process, so that only one aluminum blank is picked up from the stack at a time. One method includes jack hammering the stack of aluminum blanks to improve ease of separation. However, jack hammering oftentimes causes undesirable issues when the blanks are placed between stamping dies. Yet another method includes pushing a blade between the edges of adjacently stacked blanks and thus separating the adjacent blanks from one another. However, such a system often requires expensive machinery and sometimes causes damage to the blanks. Accordingly, there remains a need for an improved destacking tool and process capable of consistently picking up only one blank at a time.

SUMMARY OF THE INVENTION

The subject invention provides an assembly for manufacturing a plurality of blanks with at least one deformation which are stacked in such a way to define a space between adjacently stacked blanks by the deformation for consistent one at a time destacking at the start of the next production line process. A metal sheet defining edges can be conveyed through the tool. The tool includes a deformer assembly with an engagement element disposed adjacent to at least one edge of the metal sheet for pressing a deformation therein. The tool also includes an opposing surface which defines at least one cavity for accepting part of the metal sheet while it is being pressed by the engagement element forming the deformation.

The invention also provides a method of manufacturing a plurality of stacked blanks for future processing. The method includes aligning an edge of a metal sheet with a deformer assembly and feeding the metal sheet into a tool. As the metal sheet is conveyed through the tool at least one deformation is pressed into the metal sheet. Next, the metal sheet is trimmed into a plurality of metal blanks with each metal blank having at least one deformation. The metal blanks are then stacked for future processing so that at least one edge of each metal blank is spaced from at least one edge of the adjacently stacked metal blanks by the deformation.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE EXAMPLE EMBODIMENTS

Figure 1:
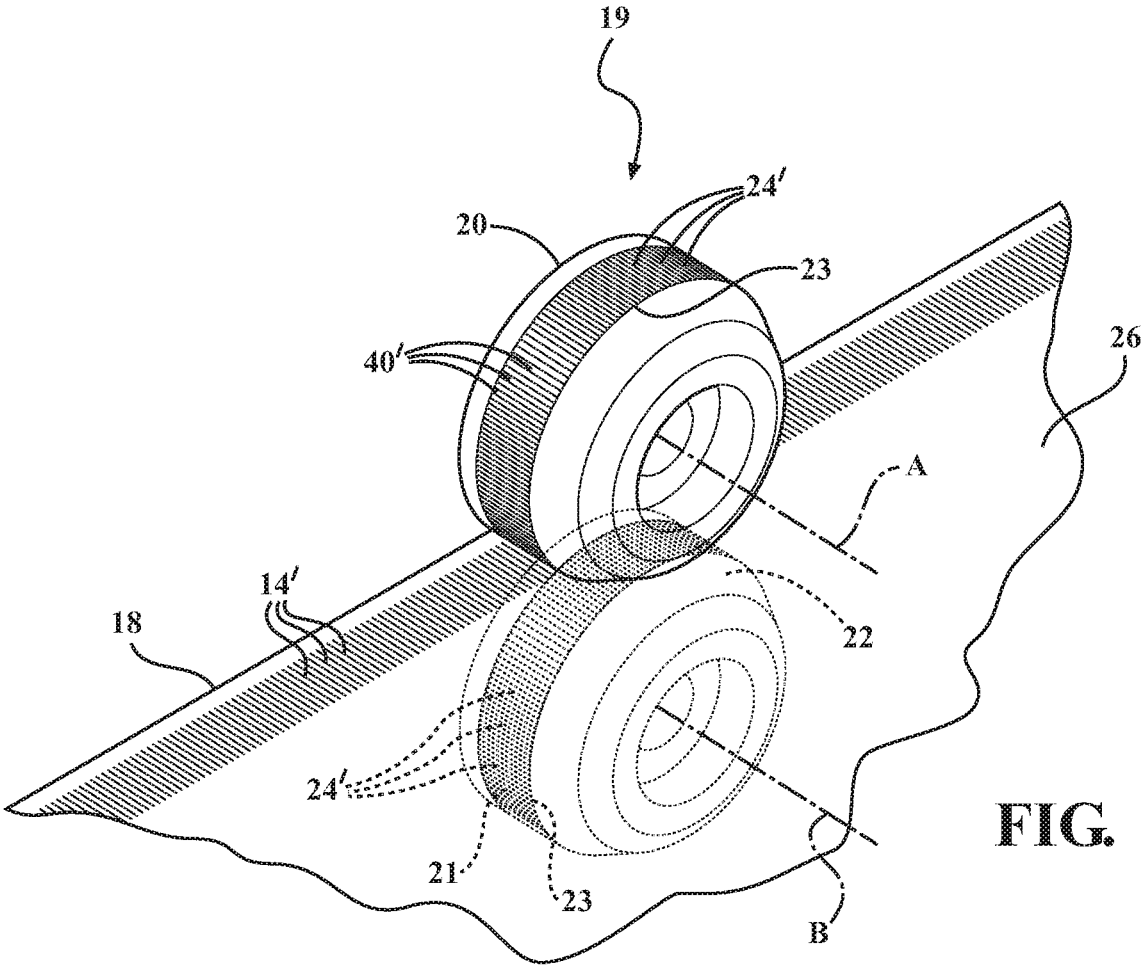
FIG. 1 is a perspective view of a tool for forming serrations in a plurality of blanks to be stacked and destacked, according to an example embodiment.

The invention provides a tool 10 and process for manufacturing a plurality of blanks 12 for a production line. The blanks 12 are initially stacked together and then destacked for further processing. The invention also provides the blanks 12 formed by the tool 10 and process. Each blank 12 includes at least one deformation 14 such as serrations 14' and/or dimples 14", which establish a small gap 13 between adjacent blanks 12 in the stack. The gaps 13 provide for more reliable separation of the blanks 12 from the stack, and thus improve the destacking process. More specifically, the gaps 13 allow for consistent one at a time destacking at the start of the next production line process. The blanks 12 are formed from a metal material, typically aluminum or an aluminum alloy. However, the blanks 12 could be formed of other metal materials.

The tool 10 is constructed to convey a metal sheet 26 therethrough and includes a deformer assembly 19 that has an engagement element 24', 24" for establishing deformations 14 into the metal sheet 26. The tool 10 further includes an opposing surface 21 disposed in an adjacent and spaced relationship to the deformer assembly 19 on the opposite side of the inserted metal sheet 26 to facilitate pressing deformations 14 into the metal sheet 26. Specifically, the opposing surface 21 defines a cavity 40 disposed adjacent to the engagement element 24', 24" for accepting part of the deformation 14 while it is being pressed. The opposing surface 21 maintains the metal sheet 26 around the cavity 40 and prevents the entire metal sheet 26 from bending upon pressure from the engagement element 24', 24", only allowing the metal sheet 26 to bend and form into the cavity 40. It should also be appreciated that in certain embodiments, if the deformation 14 is deep enough, the cavity 40 can also accept part of the engagement element 24.

Figure 2:
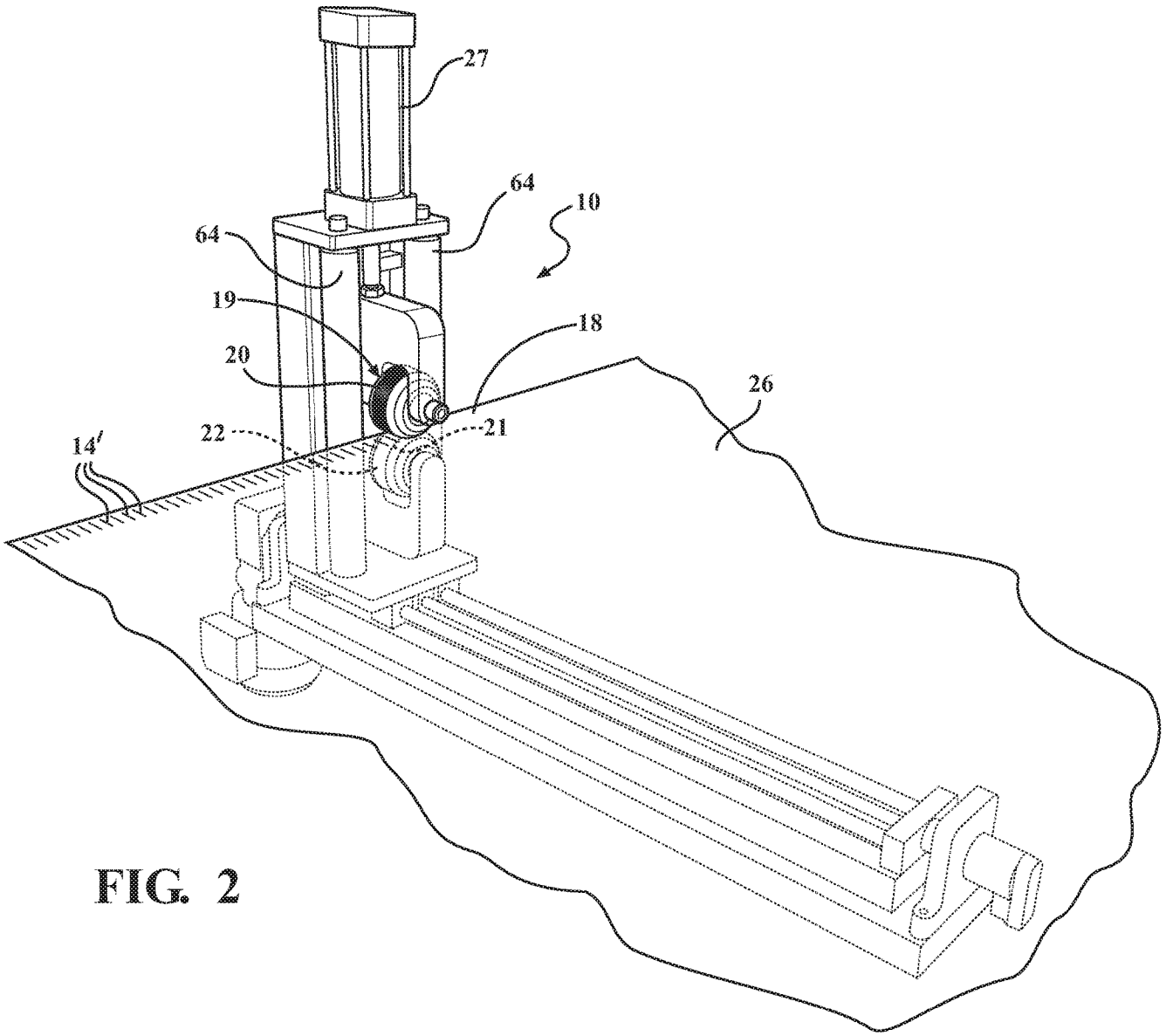
FIG. 2 is another view of the tool for forming the serrations in the blanks according to the example embodiment.
Figure 9:
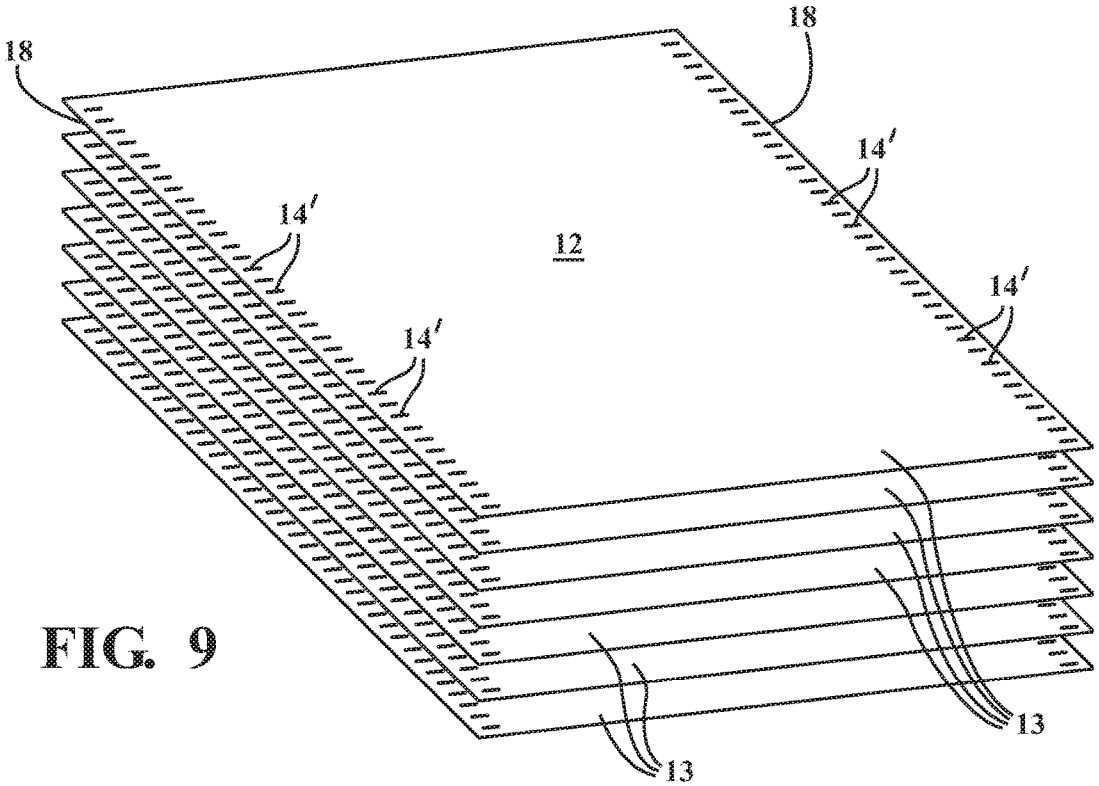
FIG. 9 illustrates the stacked blanks including the serrations formed by the tool of FIG. 2.

FIGS. 1 and 2 illustrate one example of the tool 10 used to manufacture the blanks 12, wherein the blanks 12 are formed from a metal sheet 26 having a generally planar surface and at least one edge 18. In this embodiment, the deformation 14 is a continuous line of serrations 14' along the at least one edge 18. An example of the stacked blanks 12 including the serrations 14' formed by the tool 10 of FIGS. 1 and 2 is shown in FIG. 9. According to this embodiment, the deformer assembly 19 is an upper serrator 20 presenting an opening along upper center axis A and a lower serrator 22 presenting an opening along lower center axis B. The upper serrator 20 and lower serrator 22 can also be referred to as rollers. Each senator 20, 22 also presents a flat outer diameter surface 23 which includes a plurality of engagement elements 24' or specifically in this embodiment, ribs 24' extending parallel to the respective center axis A, B. The ribs 24' are spaced apart by cavities 40 and form the serrations 14' in the blanks 12. In this embodiment, the ribs 24' present a gear profile between the senators 20, 22 with the space between each rib 24' defining a space 40' for accepting deformations 14 pressed by an opposing rib 24'. In this example embodiment, each serrators 20, 22 is an opposing surface 21 to the other senator 20, 22. The upper serrator 20 is movable upward and downward using an arm 27. The arm 27 could be pneumatic, hydraulic or driven by any other means. The lower serrator 22 is fixed. As shown in FIGS. 1 and 2, the upper and lower senators 20, 22 are longitudinally aligned so that the ribs 24' of the serrators 20, 22 extend parallel to one another. It should be appreciated that the lower serrator 22 could be movable while the upper serrator 20 is fixed. Furthermore, the opposing surface 21 could be a rack gear or any other structure suitable for allowing deformations 14 pressed from a serrator 20, 22 to extend partially therein. In yet another embodiment, the metal sheet 26 has a pair of opposite edges 18 and the deforming assembly 19 includes two pairs of serrators 20, 22 each aligned with one of the pair of edges 18 for forming serrations 14' along each of the opposite edges 18.

The process for manufacturing the blanks 12 using the tool 10 of FIGS. 1 and 2 includes unwinding a metal sheet 26 from a coil and conveying the metal sheet 26 between the upper serrator 20 and the lower serrator 22. The metal sheet 26 is placed so that the edge 18 of the metal sheet 26 is aligned with the ribs 24' of the serrators 20, 22 adjacent to a guide 64. The guide 64 aligns the edge of the metal sheet 26 rectilinearly and adjacently relative to the senators 20, 22 while the metal sheet 26 is passed through the tool 10. When the metal sheet 26 rolls in a flow direction over the lower serrator 22, the upper serrator 20 is moved downward. The metal sheet 26 travels through the gear profile provided by the ribs 24', which forms the continuous line of serrations 14' along the edge 18 of the metal sheet 26. After forming the serrations 14', the metal sheet 26 can be cut into the plurality of blanks 12. Preferably, the tool 10 that includes serrators 20, 22 is located at a trimming station, or is located remotely but used prior to the trimming station used to cut the metal sheet 26 into the plurality of blanks 12.

The serrations 14' in the blanks 12 formed by the tool 10 and process of FIGS. 1 and 2 provide a plurality of projections extending transversely from a flat surface of the blank 12. Thus, when the blanks 12 are stacked together, the serrations 14' provide for the gap 13 between each blank 12 and the adjacently stacked blank 12. The small gaps 13 between the blanks 12 provide an entry for an air knife to blast air therebetween and separate the blanks 12 for pick up by suction cups or another device or method, so that only one blank 12 from the stack is picked up at a time for transfer to a subsequent process step, such as stamping or pressing. Thus, a more reliable destacking process is provided. In addition, the serrations 14' are not expected to present a problem when the blanks 12 are subsequently stamped, pressed, or otherwise formed.

Figure 3:
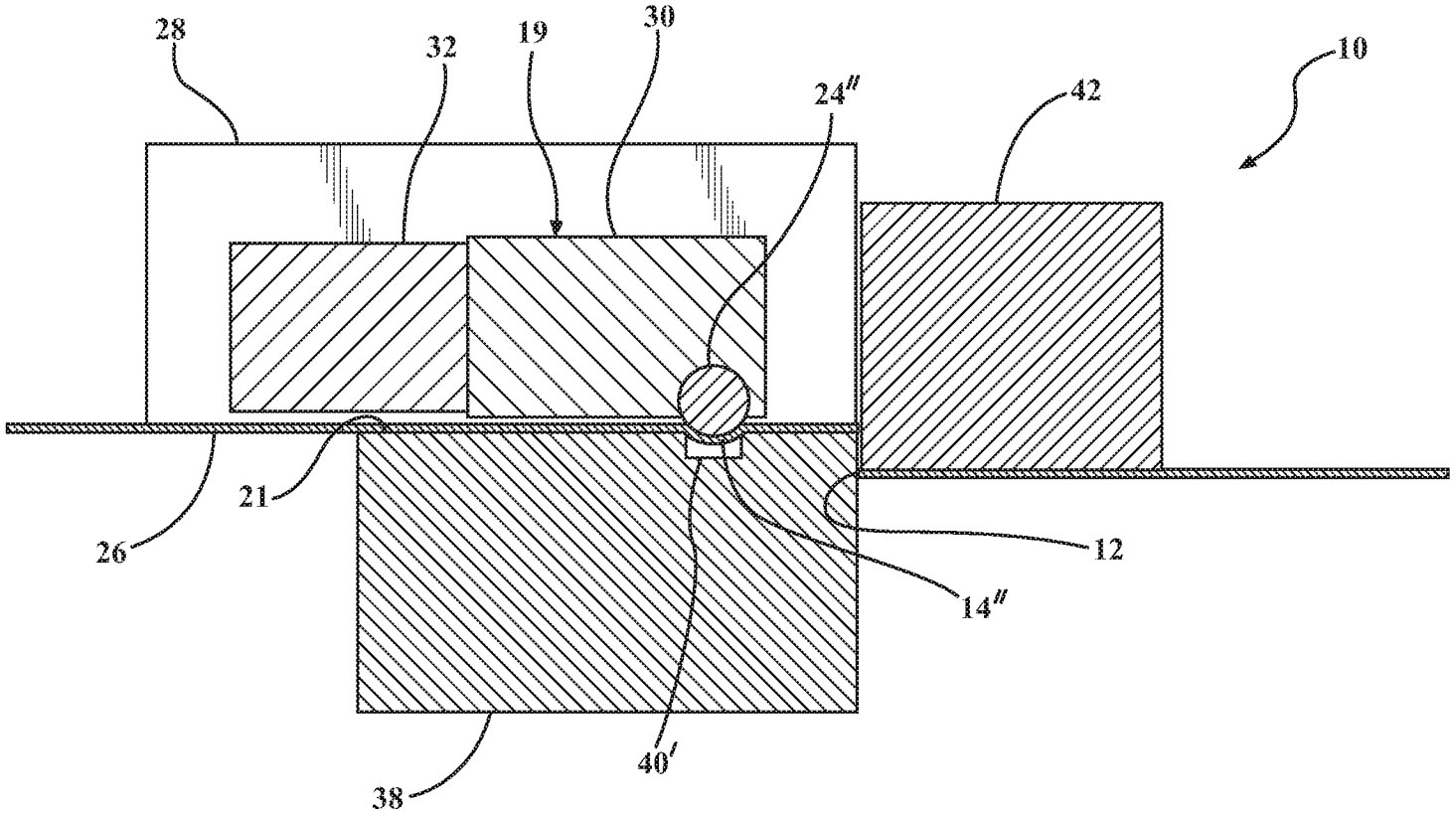
FIG. 3 is a perspective view of the tool for forming dimples in a plurality of blanks to be stacked and destacked, according to another example embodiment.
Figure 4:
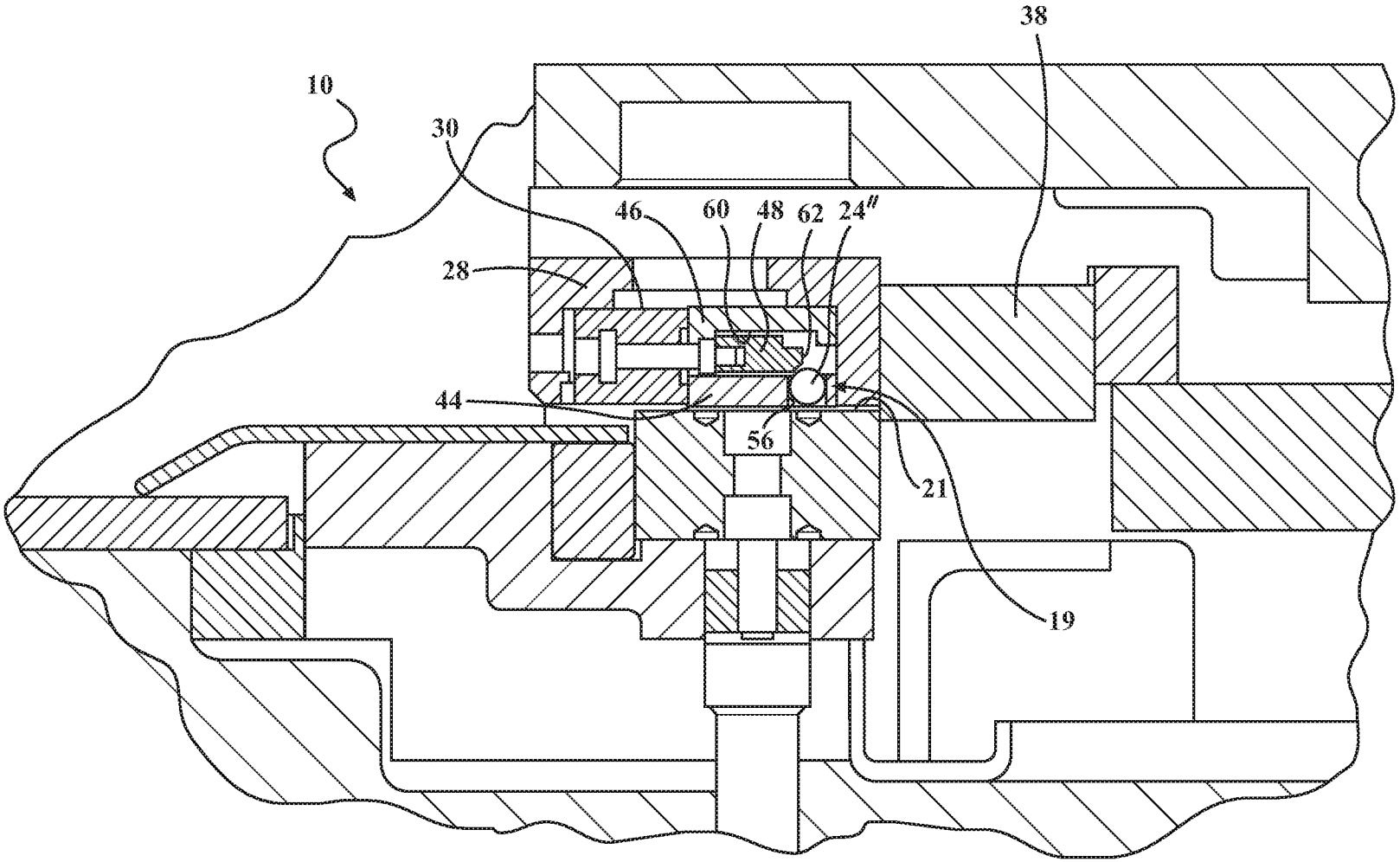
FIG. 4 is another view of the tool used to form the dimples in the blanks when the tool is incorporated into a blanking die used for trimming.
Figure 6:
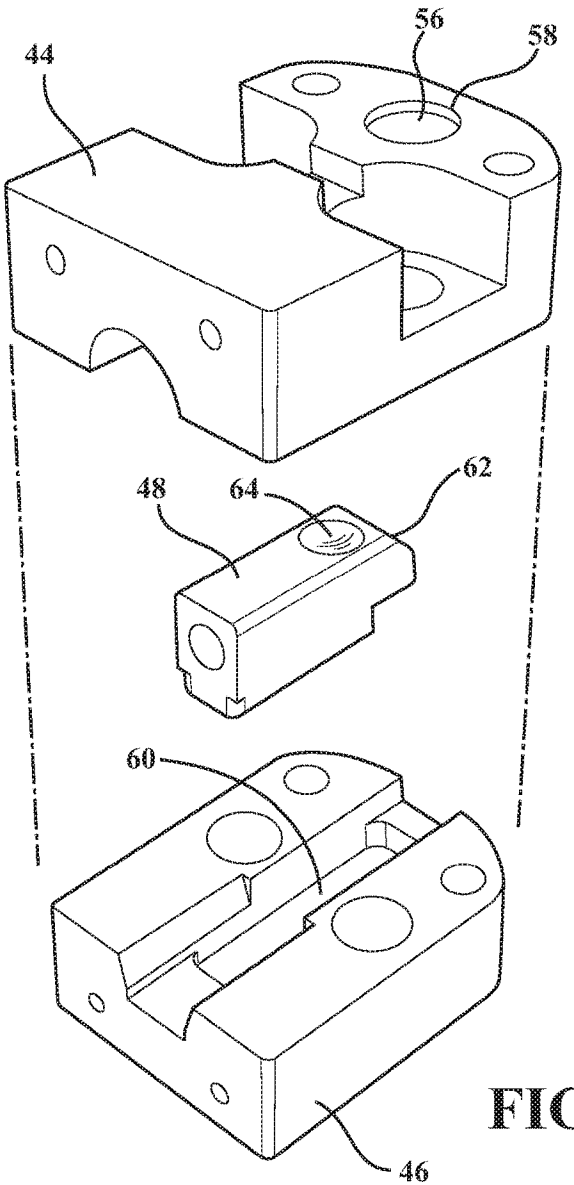
FIG. 6 is an exploded view of the ball bearing unit present in the tool according to an example embodiment.
Figure 5:
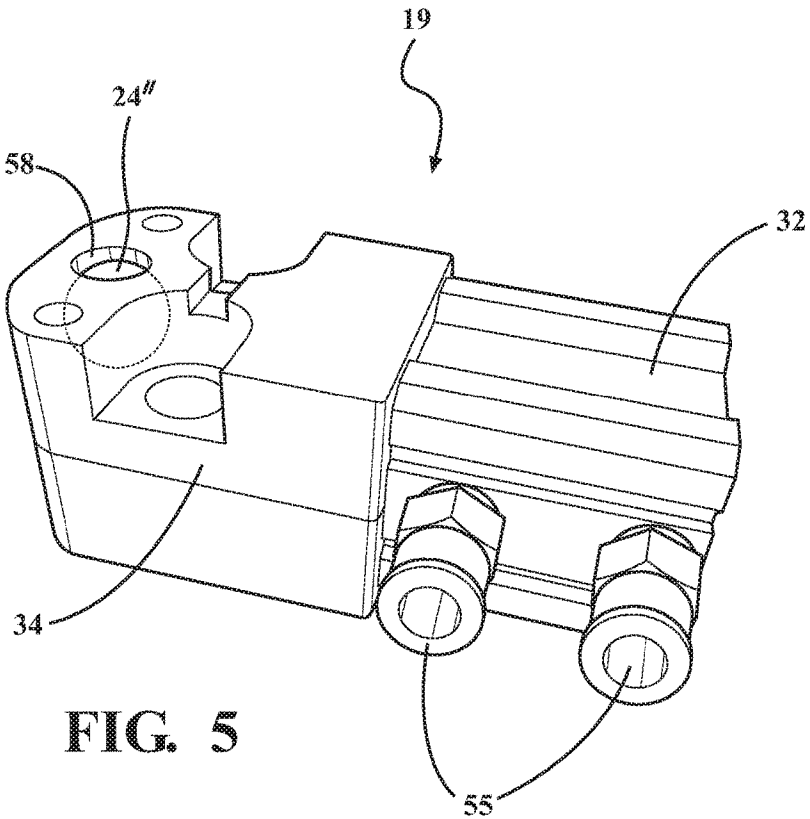
FIG. 5 is a view of the ball bearing unit present in the tool according to an example embodiment.

FIGS. 3-8 illustrate another example of the tool 10, wherein the at least one deformation 14 formed in the blanks 12 includes a dimple 14" along at least one edge 18 of the metal sheet 26. According to this embodiment, the deformer assembly 19 is a dimpler unit 30 secured to an upper die stripper pad of an upper stripper plate 28. Alternatively, the design could be modified such that the dimpler unit 30 is secured to a lower die stripper pad of a lower stripper plate or a dimpler unit 30 secured to the lower die stripper pad and another dimpler unit 30 secured to the upper die stripper pad. As shown in FIG. 3, the dimpler unit 30 includes an air cylinder 32, and a ball bearing unit 34. The ball bearing unit 34 includes an engagement element 24" i.e., a ball bearing 24" extending downward from the upper stripper plate 28 to form the dimple 14" in each blank 12.

According to the example embodiment shown in FIG. 3, the dimpler unit 30 is located at a blanking die assembly used to trim the metal sheet 26 into the plurality of blanks 12. The blanking die assembly includes the upper stripper plate 28 and a lower trim steel 38 for receiving the metal sheet 26 therebetween. In one embodiment, the lower trim steel 38 is an opposing surface 21 to the ball bearing 24" and includes a clearance recess 40" for receiving the dimple 14" formed by the ball bearing 24". The die assembly also includes an upper trim steel 42 for trimming the metal sheet 26 into the plurality of blanks 12 immediately after forming the dimple 14".

Figure 7:
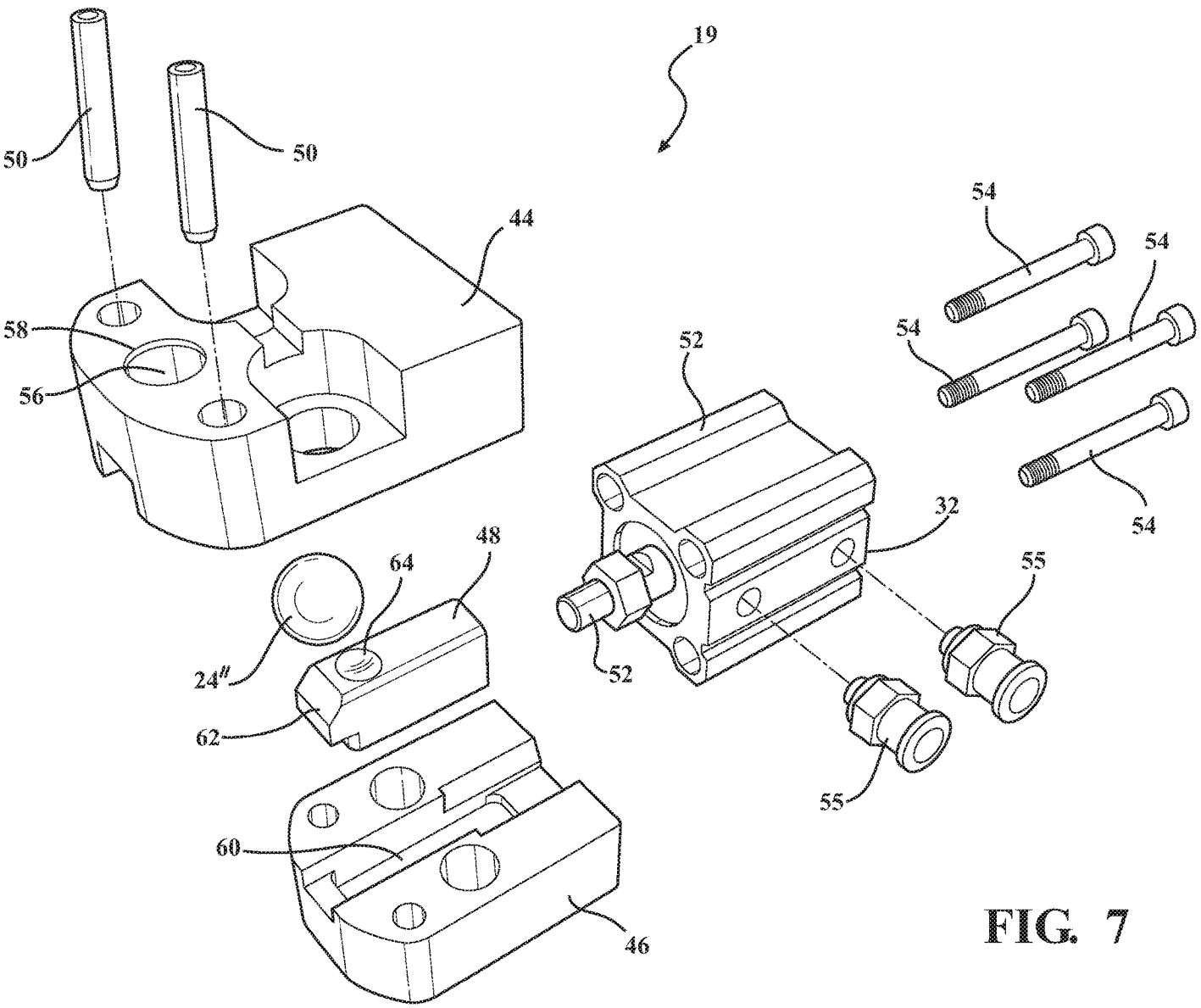
FIG. 7 is yet another exploded view of the ball bearing unit present in the tool according to an example embodiment.
Figure 8:
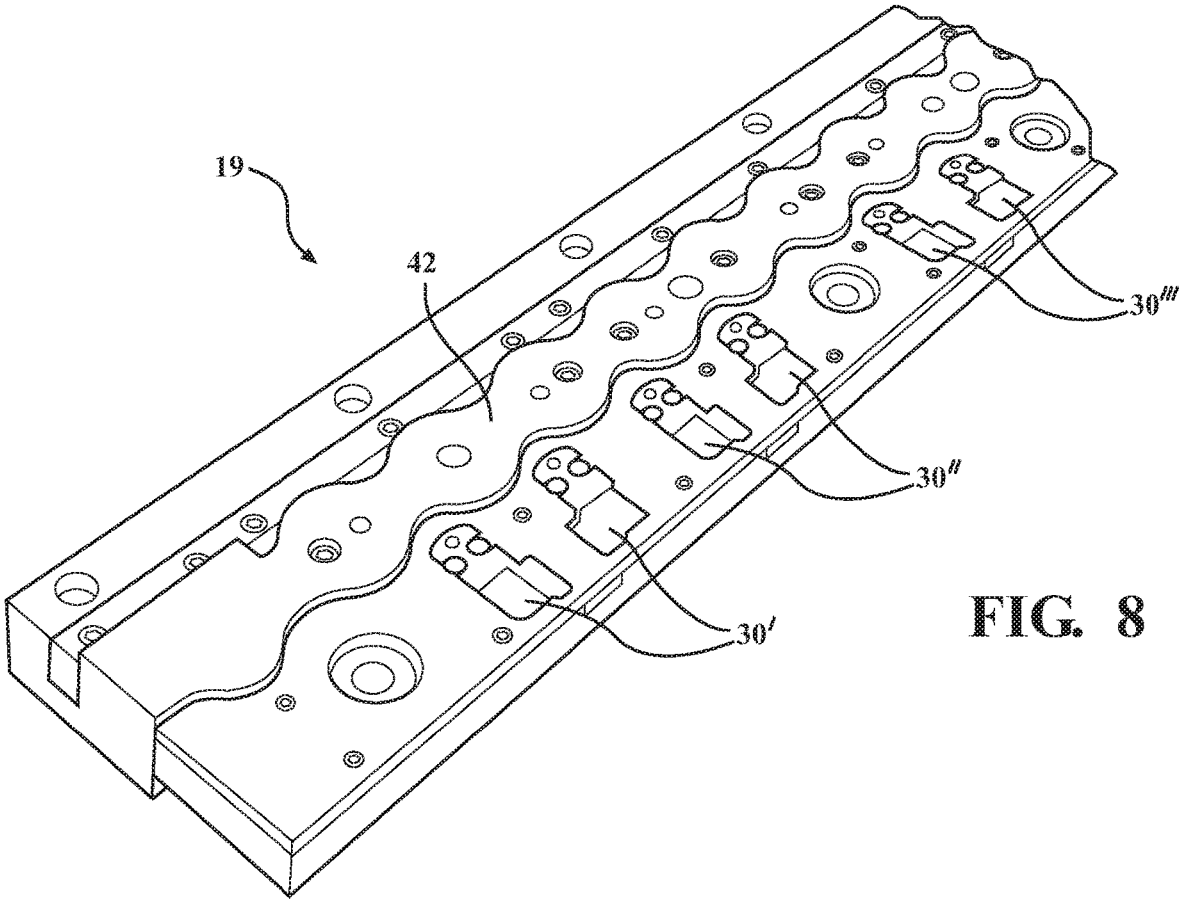
FIG. 8 illustrates three sets of dimpler units according to an example embodiment.

FIGS. 4-7 illustrate details of the ball bearing unit 34, i.e., an actuator 35 of the dimpler unit 30 according to the example embodiment. In this case, the ball bearing unit 34 includes an upper body portion 44, a lower body portion 46, and a dimpler slider 48 located therebetween. The ball bearing unit 34 further includes the ball bearing 24" disposed adjacent to the dimpler slider 48 and between the upper and lower body portions 44, 46. The ball bearing unit 34 further includes a pair of dowels 50 disposed in the upper body portion 44, and the air cylinder 32 includes a punch 52 that is disposed adjacent the body portions 44, 46. A plurality of bolts 54 and air hose fittings 55 are disposed in the air cylinder 32, as shown in FIG. 7.

In the example embodiment shown in FIG. 7, the bearing unit 34 defines a passage 56 for allowing the ball bearing 24" to move into contact with the metal sheet 26. The passage 56 includes a rim 58 having a diameter less than the ball bearing 24" for preventing the ball bearing 24" from falling out of the bearing unit 34. The bearing unit 34 further defines a channel 60 perpendicular to the passage 56 for allowing the dimpler slider 48 to move toward the ball bearing 24". The dimpler slider 48 defines an angled contact point 62 and is biased away from the ball bearing 24" by a spring or the like. Accordingly, upon opening the air cylinder 32, the punch 52 hits the dimpler slider 48 which in turn rams into the ball bearing 24" and the ball bearing 24" is moved perpendicularly to the dimpler slider 48 as the angled contact point 62 is wedged between the ball bearing 24" and the lower body portion 46. The dimpler slider 48 further defines a nook 64 for nesting the ball bearing 24" when the dimpler slider 48 is wedged between the ball bearing 24" and the lower body portion 46. When the air cylinder 32 is closed, the dimpler slider 48 will be retracted away from the ball bearing 24".

Figure 10:
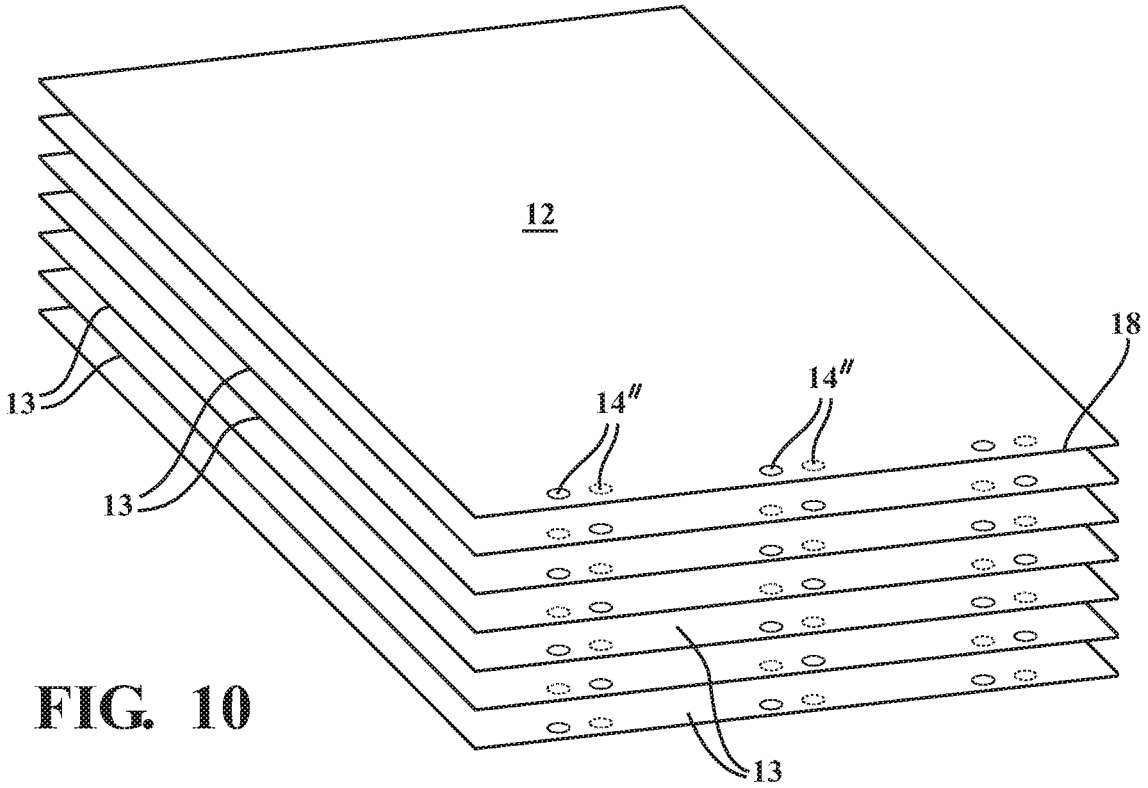
FIG. 10 illustrates the stacked blanks including the dimples formed by the assembly of FIG. 8.

Preferably, the process includes forming a plurality of the dimples 14" in each blank 12. Thus, multiple dimpler units 30 are installed in the upper die stripper pad, for example pairs or sets of the dimpler units 30. In the example embodiment, three sets of dimpler units 30', 30", 30'" are installed. An example of the three sets of dimplier assemblies 30', 30", 30'" is shown in FIG. 3-7. The press automation of the blanking die assembly is programmed to activate an alternate dimpler unit 30 or set 30', 30", 30'" for every other blank 12 being trimmed so that the dimples 14" formed have a different location from one blank 12 to the next. The alternating dimples 14" provide for the gaps 13 between the adjacent blanks 12 when the blanks 12 are stacked. In the example embodiment, the dimples 14" have a concave profile, but the dimples 14" could comprise other shapes. An example of the stacked blanks 12 including the dimples 14" formed by the dimpler units 30 is shown in FIG. 10.

The process for manufacturing the blanks 12 using the tool 10 of FIGS. 3-7 includes unwinding the metal sheet 26 from the coil and conveying the metal sheet 26 between the upper stripper plate 28 and the lower trim steel 38. The edge 18 of the metal sheet 26 is aligned with the ball bearing 24". The process further includes pressing the ball bearing(s) 36 into the metal sheet 26 while the metal sheet 26 is conveyed between the upper stripper plate 28 and lower trim steel 38. After forming the at least one dimple 14" in the metal sheet 26, the method includes cutting the metal sheet 26 between the upper trim steel 42 and the lower trim steel 38 to form the plurality of blanks 12. The blanks 12 are then stacked for future processing. As discussed above, the dimples 14" provide the small gaps 13 between the stacked blanks 12 which provide an entry for the knife to blast air therebetween. Thus, one blank 12 at a time can be reliably separated from the stack, picked up by suction cups, and transferred to the subsequent process step, such as stamping or pressing. The separation process can be automated by incorporating the dimpler unit 30 into the blanking die assembly. The automation is determined by the material being run and for each stroke of the upper trim steel 42 in the trimming operation. For example, when multiple dimpler units 30 are incorporated into the blanking die assembly, the blanking die assembly has the ability to power each dimpler unit 30 independently.

Figure 11:
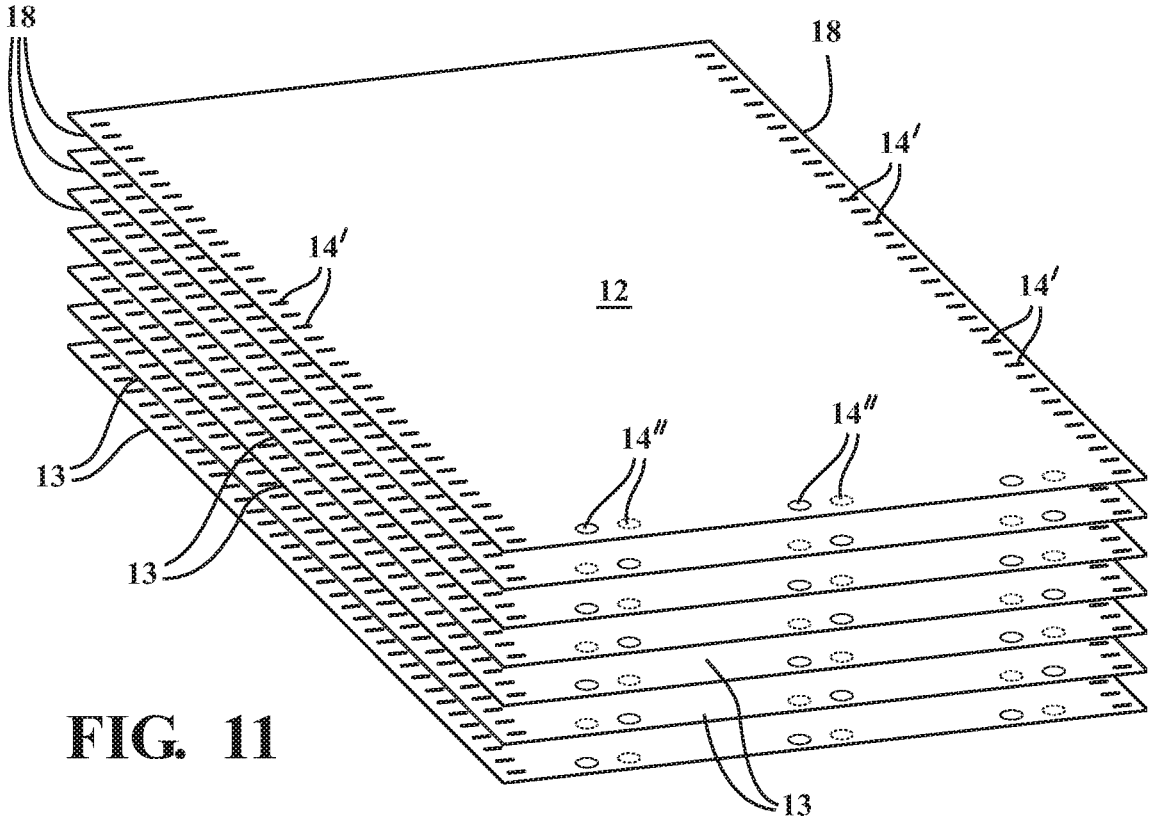
FIG. 11 illustrates the stacked blanks including the serrations formed by the tool of FIG. 2 and the dimples formed by the assembly of FIG. 8.

According to yet another embodiment, the tool 10 includes a combination of both embodiments. In this case, the serrators 20, 22 presenting the gear profile with ribs 24' and the ball bearings 24" are used to form deformations 14 including both the serrations 14' and the at least one dimple 14" in each blank 12. The combination of the serrations 14' and the dimples 14" provide for improved destacking of the blanks 12. An example of the stacked blanks 12 including the serrations 14' formed by the serrators 20, 22 of FIGS. 1 and 2 and the dimples 14" formed by the dimpler units 30 of FIG. 3-7 is shown in FIG. 11.

Certain features are, for clarity, described herein in the context of separate embodiments, may also be provided in combination in a single embodiment. Conversely, various features that are, for brevity, described in the context of a single embodiment, may also be provided separately or in any sub combination. Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. An assembly for forming a plurality of stacked metal blanks having at least one edge comprising:

a blanking die assembly including a stripper plate and an opposing surface disposed in adjacent and spaced relationship to said stripper plate for conveying a metal sheet therebetween;

at least one dimpler unit secured to said stripper plate and including a ball bearing for forming at least one dimple into the at least one edge of the conveyed metal sheet;

said opposing surface defining at least one cavity disposed adjacent to said ball bearing for accepting part of the at least one dimple formed by said ball bearing;

said dimpler unit including a bearing unit defining a passage housing said ball bearing, said passage extendingly perpendicularly to said opposing surface and terminating at an open end disposed adjacent said opposing surface; and said bearing unit defining a channel extending perpendicularly to said passage and a dimpler slider slideably disposed in said channel and movable between a retracted position wherein said dimpler slider is retracted away from said ball bearing and a contact position wherein said dimpler slider is disposed in abutting relationship with said ball bearing for moving said ball bearing towards said open end of said passage and into contact with said metal sheet to form the at least one dimple.

2. The assembly as set forth in claim 1 wherein said dimpler unit further includes an air cylinder for effectuating movement of said dimpler slider from said retracted position to said contact position.

3. The assembly as set forth in claim 1 further including at least one serrator disposed on an axis in rotational engagement with said metal sheet for forming serrations therein.

4. The assembly as set forth in claim 1 wherein said at least one dimpler unit includes a plurality of dimpler units for pressing multiple dimples simultaneously into the metal sheet.

5. The assembly as set forth in claim 1 wherein said at least one dimpler unit includes a plurality of dimpler units each configured to activate independently from one another for forming dimples in different locations in adjacently stacked metal blanks.

6. The assembly as set forth in claim 1 wherein said open end of said passage includes a rim having a diameter less than said ball bearing for preventing said ball bearing from falling out of said bearing unit during movement towards said metal sheet.

7. The assembly as set forth in claim 1 wherein said dimpler slider defines an angled contact surface being angled relative to said passage for being disposed in engaging relationship with said ball bearing during movement of said dimpler slider from said retracted position to said contact position.

8. The assembly as set forth in claim 1 wherein said dimpler slider defines a nook for nesting said ball bearing when said dimpler slider is disposed in said contact position.

* * * * *